United States Patent [19]

Savell, Jr. et al.

[11] 4,207,632

[45] Jun. 17, 1980

[54] DRAIN MEANS

[76] Inventors: Jesse J. Savell, Jr., 1645 Alston Ave., Colton, Calif. 92324; Jess R. Coffey, 25632 Mead St., Loma Linda, Calif. 92354

[21] Appl. No.: 947,764

[22] Filed: Oct. 2, 1978

[51] Int. Cl.[2] ..... E04C 1/22; E03D 11/16; A47K 3/08

[52] U.S. Cl. ..... 4/288; 4/613; 4/191; 285/58; 285/158

[58] Field of Search ..... 4/146, 173 M, 187 A, 4/191, 195, 252 R, 287, 288, 290, 292, 420, DIG. 7, 145, 286, 1, 173 R; 277/101; 285/58, 59, 158, 178, 56, 60; 138/89; 141/337

[56] References Cited

U.S. PATENT DOCUMENTS

| | | | |
|---|---|---|---|
| 342,452 | 5/1886 | McEntee | 4/288 |
| 711,845 | 10/1902 | Fountain et al. | 4/288 |
| 1,793,681 | 2/1931 | Crowell | 285/58 |
| 2,121,984 | 6/1938 | Rieger et al. | 285/58 |
| 2,672,205 | 3/1954 | McDonald | 4/146 X |
| 2,836,437 | 5/1958 | Waymon | 285/178 X |
| 2,845,631 | 8/1958 | Kozlowski | 285/178 X |
| 3,051,501 | 1/1962 | Minella | 285/178 X |
| 3,311,391 | 3/1967 | Harrell | 285/58 |
| 3,319,268 | 5/1967 | Blumenkranz | 285/58 X |
| 3,486,523 | 12/1969 | Mullings | 285/158 |
| 3,675,384 | 7/1972 | Knecht | 4/146 X |
| 3,775,780 | 12/1973 | McEwen | 277/101 X |
| 3,807,744 | 4/1974 | Gibling | 285/58 X |
| 3,967,836 | 7/1976 | Izzi, Sr. | 4/252 R X |
| 4,161,043 | 7/1979 | Flores | 4/292 |

FOREIGN PATENT DOCUMENTS 381262 11/1907 France .

*Primary Examiner*—Stuart S. Levy
*Attorney, Agent, or Firm*—John H. Crowe

[57] ABSTRACT

A drain for a prefabricated shower stall that can be quickly and easily connected to a drain pipe, even though the drain pipe might be off-center with respect to the shower drain opening. The drain consists of two interfitting parts, a first of which is a drain body designed for attachment to the shower stall, and the second of which is a bushing-like member designed to interconnect the drain body and drain pipe. The drain body has a round opening, with a converging wall, extending through it, and an outwardly extending flange by means of which it can be affixed to a prefabricated shower stall around the drain opening in the stall. The converging wall of the opening in the drain body serves as a seat for the second part of the drain, which has a frustoconical outer wall to make this possible. This second part has a cylindrical bore concentric with its outer wall and is of such size as to extend below the first part, when seated therein, and telescopically receive the drain pipe in its cylindrical bore. A prefabricated shower stall with the first part of the drain attached can be quickly installed in position over a standing drain pipe by applying suitable glue to appropriate surfaces of the involved parts and then seating the second part of the drain in the first part, while pushing it into telescoping interfit with the drain pipe.

9 Claims, 4 Drawing Figures

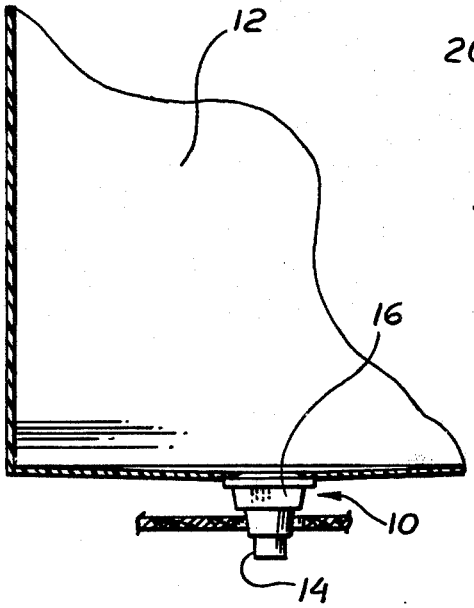
FIG. 1.
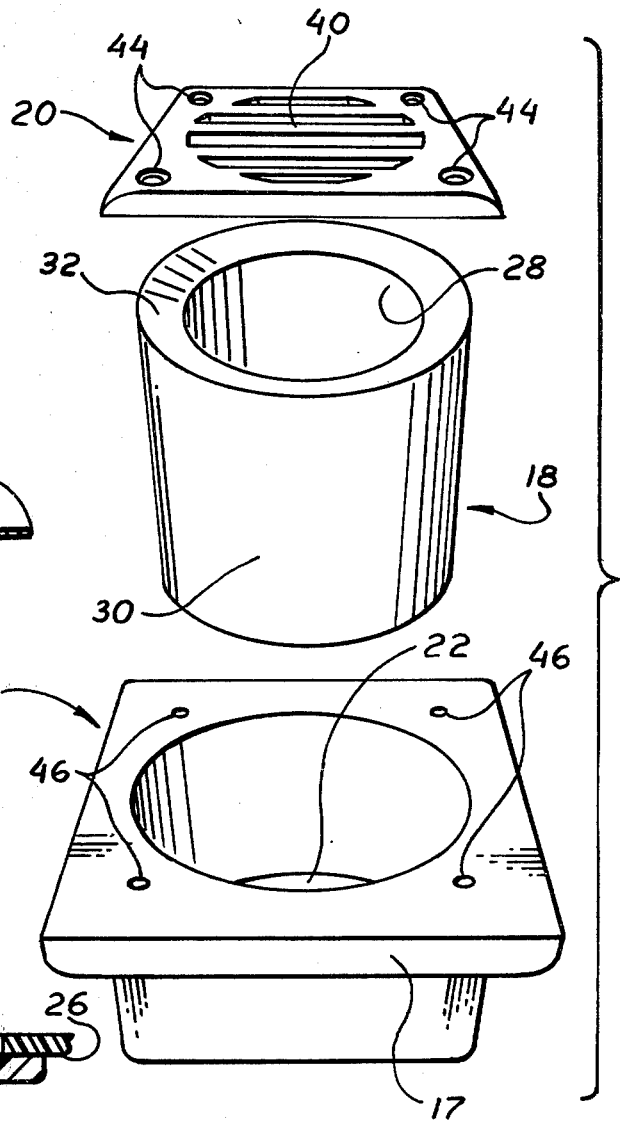
FIG. 2.
FIG. 3.
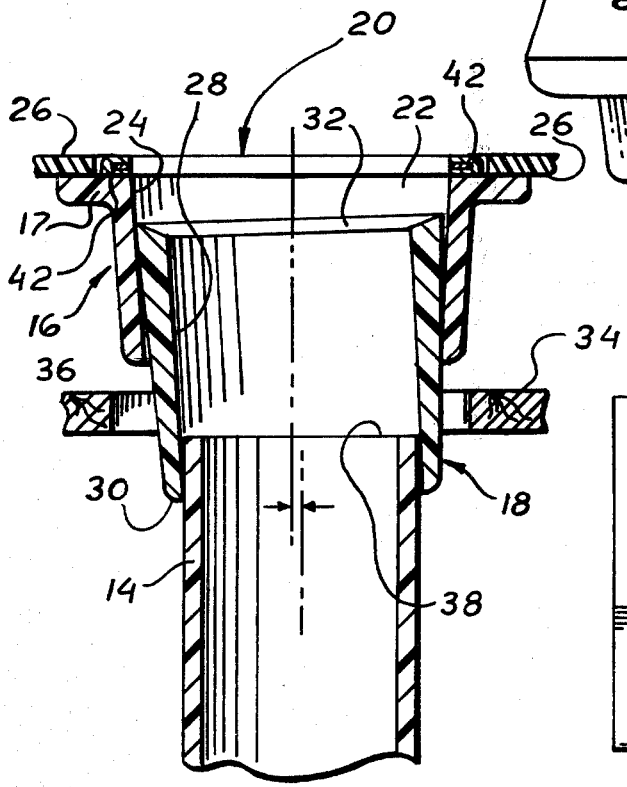
FIG. 4.
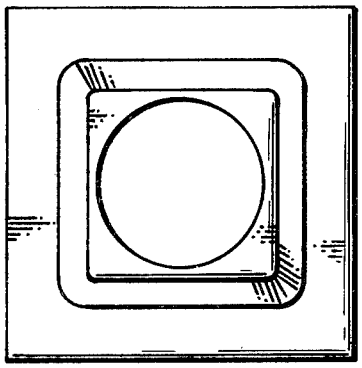

DRAIN MEANS

BACKGROUND OF THE INVENTION

This invention relates generally to drain fittings for shower stalls and the like, and more particularly to such fittings designed to facilitate the quick and easy installation of prefabricated shower stalls in buildings under construction.

While prefabricated shower stalls such as, for example, prefabricated fiberglass stalls, have come into widespread usage in new homes, motels, and the like, in recent years, because of their cost-savings advantages over conventional tile showers, the actual hook up of such a stall with a drain pipe in the conventional way is tedious and time consuming. As a first step in this hook up procedure, a plumber installs a vertical drain pipe in more or less the proper position for connection with the shower drain, with its upper end disposed just above the floor level at the shower site. Next, the shower stall is placed in position over the drain pipe. The shower stall conventionally has a drain "receptor", attached, which is a depending cylindrical fitting sealed to the bottom of the shower stall around a drain opening therein. The receptor normally has an inside diameter a quarter of an inch larger than the outside diameter of the drain pipe, and the latter (drain pipe) is hopefully positioned to fit within this receptor, ideally with a radial clearance of about an eighth of an inch all around, when the shower stall is properly positioned. The resulting annular space between the receptor and drain pipe is filled with a suitable caulking material or plumber's lead to seal the joint. All of this takes time, normally from half an hour to an hour, and involves work of a tedious and often frustrating nature, particularly where, as is often the case, the drain pipe is not properly aligned with the shower stall receptor.

In view of the foregoing, it will be apparent that the provision of drain means for prefabricated shower stalls that would permit the quick and easy hook up of the stalls with drain pipes, particularly where the drain pipes are imperfectly aligned with the shower stall drain openings, would be welcomed by everybody involved in the building, sale and purchase of new homes and other buildings. Thus such drain means would cut down greatly on labor costs, to the benefit of building contractors, home buyers, and the like, and would spare plumbers an unpleasant, time consuming chore to their welcome relief. No one, to our knowledge, however, has yet come up with such drain means. While certain types of adjustable couplings have been proposed for connecting toilet bowls, and the like, with nonaligned drain pipes, all such couplings of which we are aware have been fittings designed for installation before the fixtures themselves are installed, and all involve eccentrically adjustable openings of a type having no applicability for use with prefabricated shower stalls. See, in this connection, U.S. Pat. Nos. 1,793,681; 2,121,984; 3,775,780 and 3,967,836, which show couplings of this type.

SUMMARY OF THE INVENTION

We have now, by this invention, provided unique drain means for a prefabricated shower stall with built-in adjustability to permit quick and easy connection of the shower stall to a previously installed drain pipe at the shower location. The drain means includes a drain body having a peripheral flange that permits it to be affixed to the bottom of the shower stall around a drain opening therein. The drain body has an opening therethrough of circular cross-section defined by a frustoconical wall that serves as a seat for a bushing-like second part of the drain means.

The two parts of the drain means (drain body and bushing-like part) are preferably formed of a suitable plastic, such as, for example, polyvinyl chloride (PVC), epoxy, or other plastic of a type well known to those skilled in the art. The bushing-like part of the drain means has a cylindrical bore and a frustoconical outer wall sized and shaped to interfit with the wall of the opening in the drain body and extend beyond the lower end of that hole. Preferably, but not necessarily, the drain means includes a plastic drain grill sized to fit snugly into a drain opening in the shower stall bottom and rest on top of the drain body, the latter being sized to permit such cooperation with the grill. The grill can be provided with screw holes to permit attachment of the grill to the drain body.

Where our novel drain means is employed in the installation of a prefabricated shower in a building under construction, a plumber first provides an upright drain pipe at the shower site hopefully in line with the drain opening in the shower stall subsequently to be used. The drain pipe is preferably made to terminate just below the floor level at the shower location. The aforesaid shower stall, with the drain body part of said drain means attached, is then positioned over the drain pipe with the opening in the drain body more or less aligned with said pipe. Next, the bushing-like part of the drain means is inserted into the opening in the drain body so as to receive the upper end of the drain pipe in its cylindrical bore, which bore is sized for snug telescoping interfit therewith. Perfect alignment is not necessary here, because there is sufficient flexibility in the upstanding drain pipe to permit the bushing-like part to be telescoped onto its upper end in the described manner when there is misalignment therebetween, particularly where, as is now generally the case, the drain pipe is made of plastic.

Prior to inserting the bushing-like part of the drain means into the drain body thereof, a suitable epoxy, or other, glue or caulking material is smeared on some or all of those surfaces of the drain body, bushing-like part and drain pipe that come together in the final drain assembly. For best results, the bushing-like part is pushed firmly, as far as it will go, into the drain body, after which the glue or caulking material sets to form a watertight seal at the connection. Where a plastic drain grill of the above-mentioned type is employed, this is fastened to the drain body over the opening therein to complete the drain installation. This grill can be of any desired thickness (ordinarily such that its upper surface is level with the shower stall floor), and it can be color-coordinated with the floor pattern of the shower stall for cosmetic appeal.

Heretofore, shower drain grills have been made of metal, which does not blend harmoniously with fiberglass, tile, terrazzo, or other, shower stall surfaces, and becomes progressively less attractive with use as a result of its repeated exposure to hard water, soap alkalies, oils, etc., and consequent accumulation of layers of hard water scale, soap curd, and the like.

Our novel drain means, by virtue of its unique design and manner of installation, simplifies the plumbing of prefabricated shower stall drains to such an extent that a job which normally requires from half an hour to an hour to complete (and which can prove perversely frustrating at times) under conventional techniques now employed, can be easily accomplished in three seconds or so, and never, under ordinary circumstances, more than ten seconds. Furthermore, the technique required for installing such a shower drain utilizing our novel drain means is so simple and easy that it can be accomplished without any of the petty annoyances inherent in conventional drain installation techniques with their caulking and/or leading requirements. The parts making up our novel drain means are of simple and inexpensive construction, and designed for maintenance-free operation under normal conditions of use.

It is thus a principal object of this invention to provide drain means for prefabricated shower stalls of simple and inexpensive construction that can be installed without difficulty and in a fraction of the time conventional drains require for installation, and which requires no maintenance under ordinary use conditions.

Another object of the invention is to provide such drain means having drain grills that blend cosmetically with shower stall interiors to avoid the unattractive appearance of metal drain grills so noticeable in conventional showers.

Other objects, features and advantages of the invention will become apparent in the light of subsequent disclosures herein.

BRIEF DESCRIPTION OF THE DRAWING

FIG. 1 is a fragmentary view, partly in section, of the bottom of a prefabricated shower stall after installation thereof with a preferred form of drain means in accordance with this invention interconnecting the shower stall with a drain pipe.

FIG. 2 is an enlarged, exploded, perspective view of the cooperating parts forming said drain means, the parts being arranged in a manner to illustrate the way in which they are assembled for use.

FIG. 3 is a sectional view of the parts after they have been assembled for use in connecting a prefabricated shower stall with a drain pipe slightly out of alignment with the drain opening in the stall, the pipe being shown fragmentarily.

FIG. 4 is a bottom view, drawn to a reduced scale, of that part of the drain means shown in the lowermost position in FIG. 2.

DESCRIPTION OF THE PREFERRED EMBODIMENT

Considering now the drawing in greater detail, where like parts are designated by like reference numerals throughout, there is shown generally at 10, in FIG. 1, a preferred form of drain in accordance with this invention installed for interconnecting use between a prefabricated fiberglass shower stall body 12 and a drain pipe 14. The drain 10 comprises a pair of interfitting parts adapted to mate at a frustoconical interface to permit radial adjustment of the drain in any direction to compensate for misalignment between drain openings in shower stalls and drain pipes. The first of these interfitting parts is a drain body 16 having a penetrating passageway 22 therethrough, which passageway is defined by a frustoconical wall 24 converging downwardly as seen in its normal (FIG. 3) position of use. The drain body 16 has an outwardly extending flange 17 at the top, which flange has a flat upper surface designed to fit flush against the underside of the bottom of a fiberglass shower stall around the drain opening in the stall in the manner illustrated in FIG. 3, where parts of a shower stall bottom adjacent such an opening can be seen at 26.

Drain body 16 is preferably permanently attached to a fiberglass shower stall in the shop where the shower stall is prefabricated, although it can, of course, be attached to the stall at any time prior to the actual positioning of the stall over the drain pipe at a shower site. This does not mean that the drain body is limited to such applications, however, and we wish to have it clearly understood that it (the drain body) can be employed anywhere, and in any manner, within its structural and use capabilities as taught herein. Drain body 16 is of plastic construction, formed from any plastic material suitable for the purpose such as, for example, the PVC or epoxy plastic mentioned above. The drain body can be fastened to the bottom of a fiberglass shower stall for use with any suitable glue or cement known to those skilled in the art, such as, for example, any of the commercially available epoxy adhesives in wide usage for analogous purposes today. The attachment of the drain body to the shower stall must be such as to insure a leakproof connection therebetween, a simple matter where the attachment is properly made with a suitable glue.

For ease of illustration, shower stall 12 is shown and described herein as a prefabricated fiberglass shower stall, although the novel drain of this invention is not limited to use with fiberglass shower stalls, and can be employed with other types of prefabricated shower stalls such as, for example, prefabricated ceramic tile shower stalls of the type disclosed in our copending patent application Ser. No. 830,675, filed Sept. 6, 1977 now abandoned. The drain is, in fact, being used exclusively on shower stalls of the latter type at the present time.

The second of the two interfitting parts of drain 10 is a bushing-like member 18 having a cylindrical bore 28 and a frustoconical lateral wall 30, the bore 28 being sized to snugly receive the drain pipe 14 in telescoping interfit. The size and shape of the member 18 are such that it can pass easily into the passageway 22 of drain body 16 and mate with the frustoconical wall 24 of that passageway after it has dropped partially through the latter till its top is below the top of the drain body. See FIG. 3 of the drawing which shows drain body 16 and bushing-like member 18 very near positions of full mating interfit. The top rim of member 18 (shown at 32 on the drawing) slopes radially downwardly around, and into, the bore 28 of that member so that the annular shoulder formed thereby has diminished tendency to interfere with the flow of drain water through drain 10 or to trap foreign matter in the water and thereby prevent it from being flushed into the sewer. Here, as in the case of drain body 16, bushing-like member 18 is made of a plastic material of suitable character for its environment of use, which plastic is preferably, but not necessarily, the same as that from which the drain body is made.

The structural characteristics of the above-described parts of drain 10 and the manner in which those parts cooperate and function to achieve the advantages of this invention should now, it is believed, be apparent. Briefly, a prefabricated or precast shower stall with a drain opening in its bottom and drain body 16 sealed thereto around the drain opening can be placed in position over a previously installed drain pipe, such as drain pipe 14, as a first step in the installation of a shower in a building under construction. As previously indicated, the drain pipe will preferably be positioned with its upper end at a level below the floor level (to insure emplacement of the shower stall with no possibility of drain pipe interference). Although it has not heretofore been mentioned, drain body 16 preferably has an axial dimension short enough to permit it to clear the floor level when the shower stall is placed in position over the drain pipe. In this connection, see FIG. 3, where the floor level is shown at 34, the bottom of drain body 16 at 36, above the floor level, and the top of drain pipe 14 at 38, below said floor level. This space relationship between the drain assembly parts and their environment permits moving of the shower stall into position with no necessity of simultaneously fitting the drain pipe into any kind of a receptor on the shower stall bottom (as is conventionally required in such cases), whereby the shower installation is simplified and speeded up.

After the shower stall has been fitted in position over the drain pipe, it is only necessary to coat certain surfaces of the drain assembly parts with a suitable glue, then insert bushing-like member 18 into passageway 22 of drain body 16 on the shower stall and guide the upper end of the drain pipe into the lower end of the cylindrical bore 28 in member 18. Thereafter, bushing-like member 18 can be forced down until it is firmly seated in passageway 22. Any suitable glue capable of firmly bonding plastic parts together, and sealing their glued interfaces against leakage under the conditions of use to which shower drains are subjected, can be employed in this step of the drain installation procedure. Drain pipe 14 is shown as a plastic (e.g. PVC plastic) pipe section, as is normally the case in modern plumbing systems. Where such plastic drain pipes are employed, the aforesaid glue can be of the same type as that employed for fastening drain body 16 to the shower stall.

Although our novel drain is ideally suited for use with plastic drain pipes, it is not so limited, and can be employed for connecting a shower stall to a metal drain pipe if desired, so long as a suitable glue or caulking material is employed to seal its bushing-like member to the pipe. Obviously, the glue or caulking material for use in fastening the bushing-like member between the drain body and drain pipe can be coated on one, or both, of the mating surfaces of the various parts before the bushing-like member is forced into position between the drain body and drain pipe.

As already indicated, it is not necessary for the drain pipe 14 and drain body 16 to be in alignment for the achievement of a good tight interfit between all of the parts involved in the installation of drain 10. Because of the universal nature of the frustoconical joint between drain body 16 and bushing-like member 18, and the normal flexibility, familiar to those skilled in the art, of drain pipe 14, it is a simple matter to angle the bushing-like member and tilt the drain pipe (where necessary) to a sufficient extent to permit telescoping interfit between the two. The bushing-like member can then be driven down tightly into passageway 22 of drain body 16, as a result of which it will pull the drain pipe into substantial alignment with the drain outlet of the shower. FIG. 3 illustrates this situation, where drain pipe 14 is shown to be off-center with respect to the drain body 16 on a shower stall to which it has been attached. The bushing-like member 18 of that figure has been fitted down around drain pipe 14 but has not yet been driven to a firm seat in the drain body, as evidenced by the slight tilt of that member in said drain body. The driving of the bushing-like member to a fully seated position in the FIG. 3 drain body will straighten out its tilt and cause the drain pipe to move to the left into substantial alignment with the drain body for a good tight drain connection between the shower stall and drain pipe. For that matter, the drain could be left in its FIG. 3 position, if desired, so long as there is adequate glue or caulking material between the opposing walls of the interfitting parts to seal the drain tight against moisture leakage, although the tighter fit between the drain body and bushing-like part just described is preferred to this looser arrangement of those parts. No glue or adhesive is shown in FIG. 3, although it should be understood that such will be present when the installation of a drain in accordance with this invention has reached the stage there depicted.

Drain 10 is provided with an accessory drain grill 20 of reinforced plastic construction. The plastic here, as in the case of the above-described parts, can be of any type suitable for the purpose (PVC, epoxy, or the like). The drain grill is reinforced with a flat metallic core of sufficient strength and stiffness to preserve the integrity of the grill under the conditions it will encounter in use. This core is formed from sheet metal with outer dimensions slightly less than those of the drain grill, and with a pattern of perforations like that of the finished grill. The grill is formed by casting the plastic mix around the metallic core in a suitable mold to the desired thickness so that the core is completely imbedded in the plastic and the finished grill assimilates the grill work pattern of the core. The grill work pattern for drain grill 20 can be seen at 40 in FIG. 2, and cross-sectional parts of the metallic core of that drain grill can be seen at 42 in FIG. 3. Drain grill 20 has a thickness substantially equal to that of the bottom of fiberglass shower stall 12 to insure a level surface in the drain area of the shower (see FIG. 3, where this feature can be appreciated by comparing the thickness of the drain grill with that of the adjacent portions 26 of the bottom of the shower stall).

Drain grill 20 is secured to the top of drain body 16 in the FIG. 3 assembly by means of four screws, the drain grill being provided with four holes 44, and the drain body with four other holes 46, for that purpose. The drain grills of this invention are, of course, made of suitable sizes and shapes to fit neatly within the drain openings of prefabricated shower stalls. Drain grill 20 has a square shape to fit a square drain hole in a shower stall bottom, but it could just as easily be made round, or of any other peripheral configuration, should the occasion demand it. Likewise, the flange of the drain body of our novel drain can be made in any peripheral shape, so long as it serves its intended purpose, as taught herein, although it has a square shape on drain body 16. The same thing is obviously true of the shape of the periphery of the cross-section of that part of the drain body depending from said flange, although, again, this is of square configuration in drain body 16, as FIG. 4 shows.

As previously indicated, our novel drain grill can be made in any desired color, or color combination, to blend inconspicuously with the color scheme of a shower stall interior and thus avoid the conspicuous contrast of metal with adjacent nonmetal surfaces created by conventional metal grills. Our drain grill is unique in that it permits the use of plastic in drain areas where metal has heretofore been exclusively used. It is not necessary that the drain grill have a metallic core where a plastic of sufficient strength and toughness to undergo the rigors of use without reinforcement is employed and/or where the structural character of the grill can provide such strength and toughness without reinforcement. The drain grill can be tailor-made to any desired thickness, which makes it suitable for use with a variety of shower stall types, as exemplified, for example, by tile-faced shower stalls such as those described in our above-mentioned copending application. While our novel drain grill is greatly preferred to conventional metal grills for use with our novel drain, it is not a critically necessary part of our invention.

In summary, we have provided, in this invention, a novel drain by means of which prefabricated shower stalls can be quickly and easily connected to preinstalled drain pipes, even where the drain pipes are out of alignment with drain openings in the shower stalls. We have discovered, in this connection, that such a drain can be installed where a two inch drain pipe is offset as much as one inch from its proper position, a situation that would create a nightmare for plumbers using conventional drain installation procedures. Moreover, our drain is universally adjustable to compensate for offset of the drain pipe in any direction.

While the novel drain of this invention has been herein illustrated and described in what is considered to be a preferred embodiment, it will be appreciated by those skilled in the art that various departures may be made therefrom within the scope of the invention. Some of these departures have already been mentioned, and others will occur to those skilled in the art in the light of present teachings, an example of such being elongation of the bushing-like part of the drain to enable it to reach farther for telescoping interfit with a drain pipe.

Our novel drain is not limited to use as a shower drain, although it has been illustrated solely in that capacity herein, and can be utilized anywhere, and for any purpose, consistent with its inherent structural character and functional capability. For example, our unique drain might well be suitable for use in roof drain systems. Finally, it goes without saying that the scope of the present invention extends to all variant forms thereof encompassed by the language of the following claims.

We claim:

1. Drain means particularly suitable for use in providing a leakproof connection between an accessible drain opening in an in-place facility having such an opening and a pre-positioned drain pipe for said facility having its upstream end spaced from said opening in approximate alignment therewith, comprising:

a first part comprising a body having a through passageway of round cross-section, defined by a frustoconical wall, said body being adapted for leakproof attachment to said facility with its passageway in communication therewith through said drain opening and said passageway converging outwardly away from said facility to a location above said drain pipe; and a bushing-like second part having a round top, a round bottom and a side wall of round cross-section and frustoconical configuration, said bushing-like second part also having a passage from top to bottom therethrough, said passage being sized and shaped to receive said drain pipe in telescopically sliding interfit;

said bushing-like second part being of a size and shape to mate with the frustoconical wall of said passageway in such fashion that its top is inside the passageway and its bottom extends away from said first part sufficiently far to telescopically receive said drain pipe in said passage of said bushing-like second part;

whereby leakproof connection between said facility, with said first part affixed in said leakproof attachment thereto, and said drain pipe can be quickly and easily achieved by applying a suitable sealing preparation to certain surfaces of the first part, bushing-like second part and drain pipe, then fitting the bushing-like second part into said passageway and the drain pipe into said passage, universally moving the bushing-like second part in said passageway to permit insertion of the drain pipe into said passage if necessary due to misalignment of the drain pipe and the drain opening in said facility.

2. Drain means in accordance with claim 1 in which said passage in said bushing-like second part is cylindrical and in concentric relationship with said side wall.

3. Drain means in accordance with claim 2 in which said first part and said bushing-like second part are each formed from suitable plastic material.

4. Drain means in accordance with claim 3 in which said first part has a flange that extends radially outwardly with respect to the upstream opening of said passageway, by means of which that part can be adhesively bonded to said facility to form said leakproof attachment thereto.

5. Drain means in accordance with claim 4 in which said round top of said bushing-like second part slopes radially inwardly toward said passage to form a sloping, annular shoulder in said connection.

6. Drain means in accordance with claim 5 in which said facility is a prefabricated shower stall.

7. Drain means in accordance with claim 6 in which the upstream opening of said passageway is smaller than the drain opening in said prefabricated shower stall and the upstream end of said first part is flat and suitably sized to permit it to be affixed to said shower stall in said leakproof attachment so that a portion of said upstream end adjacent said upstream opening is exposed through said drain opening.

8. Drain means in accordance with claim 7 in combination with a drain grill formed primarily from suitable plastic material and peripherally sized and shaped to snugly fit into said drain opening whereby it can be removably secured to said upstream end of said first part adjacent said upstream opening of said passageway.

9. A combination in accordance with claim 8 in which said drain grill has flat metal reinforcing means imbedded therein, said reinforcing means having a pattern of perforations around which the plastic is formed to assimilate said pattern.

* * * * *